United States Patent [19]

MacDonald et al.

[11] Patent Number: 4,602,565

[45] Date of Patent: Jul. 29, 1986

[54] EXPLODING FOIL DETONATOR

[75] Inventors: Herbert J. MacDonald; Robert E. Zoret, both of Livermore, Calif.

[73] Assignee: Reynolds Industries Inc., Los Angeles, Calif.

[21] Appl. No.: 535,596

[22] Filed: Sep. 26, 1983

[51] Int. Cl.[4] ..... F42B 3/10

[52] U.S. Cl. ..... 102/202.7; 102/202.14

[58] Field of Search ..... 102/200, 202.5, 202.14, 102/202.7

[56] References Cited

U.S. PATENT DOCUMENTS

| | | | |
|---|---|---|---|
| 3,978,791 | 9/1976 | Lemley et al. | 102/202.14 |
| 4,144,814 | 3/1979 | Day et al. | 102/202.14 X |
| 4,312,271 | 1/1982 | Day et al. | 102/202.14 X |
| 4,471,697 | 9/1984 | McCormick et al. | 102/202.5 X |

OTHER PUBLICATIONS

Stroud, John R.; "*A New Kind of Detonator—The Slapper*"; UCRL-77639, Apr. 1, 1976.

Tucker, T. J. and Stanton, P. L., "Electrical Gurney Energy: A New Concept in Modeling of Energy Transfer From Electrically Exploded Conductors", Sandia Laboratories, May 1975.

Schwarz, Alfred C., "Flyer Plate Performance and the Initiation of Insensitive Explosives by Flyer Plate Impact, Sandia Laboratories, Dec. 1975.

"The Slapper: A New Kind of Detonator," *Energy and Technology Review,* Lawrence Livermore Laboratory, Jul. 1976, pp. 10–14.

*Primary Examiner*—Peter A. Nelson

*Attorney, Agent, or Firm*—Pretty, Schroeder, Brueggemann & Clark

[57] ABSTRACT

An exploding foil detonator for explosives in which an exploding bridge shears a foil and drives a piece of that foil against an explosive to detonate the latter.

7 Claims, 3 Drawing Figures

EXPLODING FOIL DETONATOR

BACKGROUND OF THE INVENTION

This invention relates generally to the field of explosives and more particularly to means, known as detonators, used to set off or detonate explosives. In the use of explosives to shatter or remove large masses, such as boulders, rock formations, etc., it is important that the explosive be in the proper location when it is detonated, and that other objects and people be where they will not be damaged or injured by the force of the explosion. This requires control of the time when the explosion occurs.

While explosives have long been used in various fields, their use is always subject to the dangers of premature explosion with resultant injury and damage. Explosives that produce the greatest force are likely to be explosives that are most easily detonated by heat or shock. To achieve the desired safety it is advisable to use explosives that are not likely to be unintentionally detonated by a rise in temperature or by a moderate shock. While such explosives are known, the characteristics that contribute to their safety also contribute to the difficulty of detonating them at the desired time. Thus, the detonation of such an explosive requires the use of some other explosive trigger means and the trigger means, in turn, must be one that is not subject to premature explosion. Many of these problems can be solved by the use of a less sensitive explosive such as HNS, (hexanitrostilbene) that, in turn, is detonated by means such as an exploding bridge.

It has long been known that the passage of an electric current through a conductor generates a certain amount of heat, the amount of heat varying directly with the resistance of the conductor and with the square of the current. This phenomenon is relied upon in fusible links that are installed in electrical circuits to prevent the flow of more than a predetermined amount of current in such a circuit. When the predetermined flow is exceeded, the heat melts the fusible link so that the circuit is broken. If a sufficient current is passed through the link in a small period of time, the link is not only melted but may be vaporized. If the fusible link is enclosed in a small space the vaporizing of the link can increase the pressure in that space.

For a number of years it has been customary to detonate an explosive by means of a blasting cap having a heat sensitive explosive set off by an electrical resistance heated by the passage of an electric current through the resistance. More recently, explosives have been detonated by means making use of a relatively high resistance bridge extending between conductors and through which a relatively high current is passed so that the bridge portion is not only heated to its melting point but is heated so much that it vaporizes and literally explodes to provide a shock wave to detonate the explosive. While such a system can use an explosive that is much less sensitive to heat and shock, there are still a distressing number of accidents that occur when an explosive is prematurely detonated. While less sensitive explosives have heretofore been available, it has been difficult to cause the detonation of such explosives at a selected time.

Recently, it has been proposed to detonate these more stable explosives by an electrical means of some sort that creates a sudden pressure to shear a film and form a disk or flyer which is then impacted against the explosive material.

In the construction of such a detonator, it is important that the explosive material be properly supported and sealed against the admission of materials such as moisture that would tend to deteriorate it. This is particularly important when the detonator is used in environments, such as deep wells, where the ambient pressures can become very high. It is also important that the physical construction be such that the flyer has sufficient kinetic energy imparted to it to insure the detonation of the explosive.

SUMMARY OF THE INVENTION

A detonator for a primary explosive, the detonator making use of a less sensitive secondary explosive that in turn is detonated by a flyer that is sheared from a sheet or film and propelled through a barrel to impact the secondary explosive. The flyer is sheared from the sheet by the pressure generated when an electrical conductor adjacent the sheet is vaporized by the sudden passage of a high current (as by the discharge of a capacitor) through it. The explosive is sealed against moisture, and the mechanical configuration of the detonator is such as to take full advantage of the kinetic energy of the flyer.

DESCRIPTION OF THE PREFERRED EMBODIMENT

Figure 1:
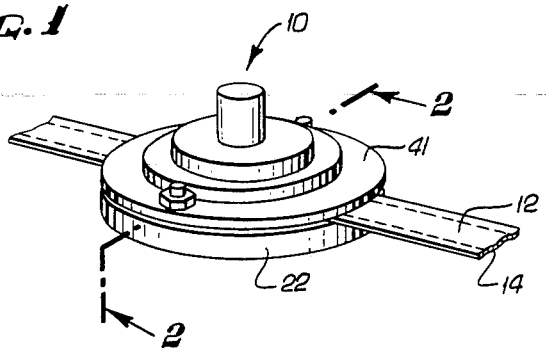
FIG. 1 is a perspective view of a detonator constructed in accordance with the present invention.

As shown in the drawings, the present invention comprises a detonator indicated generally by the numeral 10 and including an electrical bridge composed of an insulating web on ribbon 12 carrying an electrical conductor such as a foil 14. The ribbon 12 is relatively thin, and the foil 14, likewise thin and of substantially uniform thickness, is cemented or otherwise suitably held to the ribbon. While the foil 14 is generally of uniform width, it has its width reduced to form a necked-down portion 16 that provides a higher electrical resistance to current flowing through the foil.

The necked-down portion 16 is termed a bridge and it and the ribbon 12 carrying it form a bridge assembly 18. A seal member 20 bears against the foil 14, and a support member 22 presses against the seal member and provides means for supporting the detonator assembly 10.

On the side of the bridge assembly 18 away from the foil 14 is a barrel sleeve 24 aligned with the necked-down portion 16 and having a hole 26 extending through the sleeve. The surface of the barrel sleeve 24 adjacent the ribbon 12 is flat and the hole 26 forms sharp corners with the surface of the barrel sleeve. As will be hereinafter explained, the barrel sleeve 24 is to act in the manner of a die to cut a disc or flyer from the ribbon 12, and hence, it is important that the barrel sleeve have sharp edges around the hole 26, be formed of a hard material, and be firmly mounted. To this end, the barrel sleeve 24 is mounted in a cup 28 pressing against the bridge assembly 18.

Figure 2:
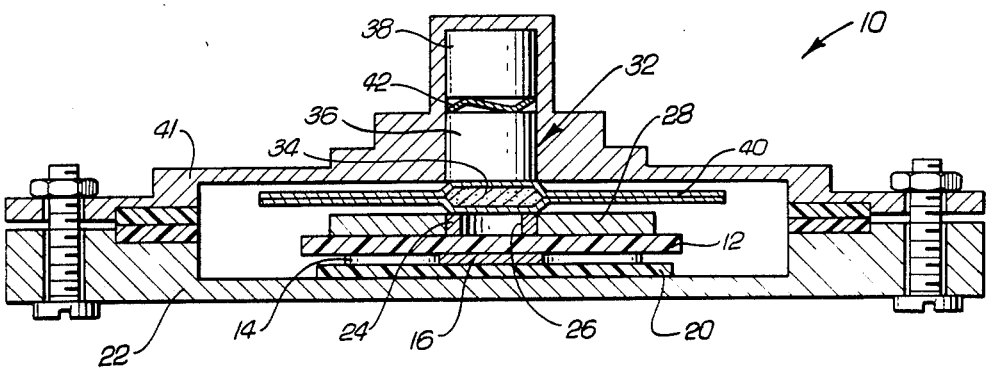
FIG. 2 is a cross sectional view of such a detonator.
Figure 3:
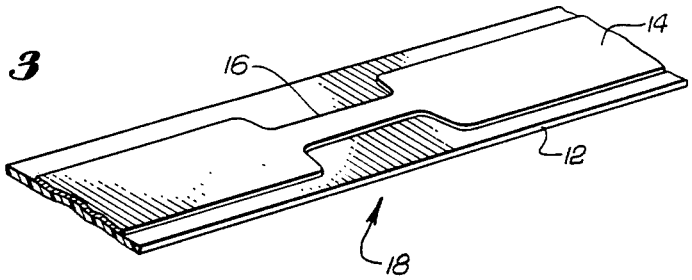
FIG. 3 is a plan view of an exploding bridge used in that detonator.

Aligned with the hole 26 of the barrel sleeve 24 is the explosive charge 32 that in the form shown is divided into three sections 34, 36, and 38. The first section or pellet 34 is immediately adjacent the barrel sleeve 24 and is enclosed in sealing means 40 that protect the explosive against moisture and yet are flexible to transmit the impact of the flyer to the explosive pellet 34. The block 36 of the explosive charge 32 bears against the pellet 34 so that the explosion of the pellet transmits a shock to the block 36 and in turn to the block 38. A housing 41 co-operates with the support member 22 to enclose the charge 32, the bridge assembly 18, and related elements. As seen in FIG. 2, the explosion block 38 bears against the housing 41 and a flat spring 42 between explosion blocks 36 and 38 presses block 36 against pellet 34 so that the entire explosive charge 32 and the bridge assembly 18 are firmly pressed together.

With the detonator 10 assembled as indicated in FIG. 2, operation is simple. The current to operate the detonator is conveniently stored in an adjacent capacitor (not shown) and upon closure of a suitable switch (not shown), the current in the capacitor is discharged through the bridge assembly 18. The charge in the capacitor is such that the flow of current is sufficient not only to melt the necked-down portion 16 of the foil 14 but to vaporize it. When this occurs, the pressure thereby generated forces the ribbon 12 against the barrel sleeve 24 and a disc-like portion is sheared from the ribbon 12 by the action of the barrel sleeve and the hole 26.

As the pressure from bridge assembly continues, the disc sheared from the ribbon 12 is driven toward the explosive pellet 34, hitting the pellet with sufficient force to detonate that explosive which in turn detonates the explosive blocks 36 and 38. The explosion of the charge 32 is sufficient to detonate a surrounding explosive (not shown) which is the main charge to be exploded. This main charge may be of whatever nature desired, and may be a shaped charge such as used in the drilling and operation of wells, a charge used in demolition, or any other charge where the explosion must be carefully timed.

It will be recognized that with this construction, the flyer or disc sheared from the ribbon 12 has a minimum distance to travel and the maximum kinetic energy can be transmitted to the pellet 34. Furthermore, with the pellet sealed within the sealing means 40 the possibility of moisture getting to the explosive is reduced to minimum. The explosive blocks 36 and 38 are preferably coated with a moisture resistant material so that they likewise are protected.

By using a detonator as described herein, the danger of premature explosion is greatly reduced. Consequently the possibility of damage and injury are correspondingly reduced and the effectiveness of the desired explosion can be increased. It will be understood that the present invention may take a variety of forms, and consequently the invention is not to be limited to the particular form or arrangement of parts herein described and shown except as limited by the claims.

We claim:

1. A detonator comprising:

an electrically-conductive bridge;

a flyer located immediately adjacent said bridge;

an explosive charge including an explosive pellet wrapped within a moisture seal, said explosive charge being spaced from said flyer;

a barrel sleeve located between said flyer and said wrapped explosive pellet, said barrel sleeve including a passageway aligned with said bridge and extending to said explosive pellet; and means for pressing said flyer and said wrapped explosive pellet against opposite ends of said barrel sleeve, to seal the passageway of said barrel sleeve, wherein passage of an electrical current through said bridge vaporizes the bridge and propels said flyer through the barrel sleeve passageway to impact upon and detonate said wrapped explosive pellet.

2. A detonator as defined in claim 1, wherein said means for pressing includes:

a rigid housing for enclosing said bridge, flyer, explosive charge and barrel sleeve; and spring-biasing means for yieldably urging said flyer and said wrapped explosive pellet against opposite ends of said barrel sleeve, to seal the passageway of said barrel sleeve.

3. A detonator as defined in claim 2, wherein said spring-biasing means includes a spring located between said wrapped explosive pellet and said rigid housing.

4. A detonator as defined in claim 1, wherein:

said explosive charge further includes first and second explosive blocks located adjacent said wrapped explosive pellet; and detonation of said wrapped explosive pellet by said flyer detonates said first and second explosive blocks.

5. A detonator as defined in claim 4, wherein said means for pressing includes a spring located between said first and second explosive blocks, for yieldably urging said first explosive block against said wrapped explosive pellet and for yieldably urging said wrapped explosive pellet and said flyer against opposite sides of said barrel sleeve, to seal the passageway of said barrel sleeve.

6. A detonator as defined in claim 4, wherein said first and second explosive blocks include moisture-resistant coatings.

7. A detonator comprising:

an electrically-conductive bridge;

a flyer located immediately adjacent said bridge;

an explosive charge including an explosive pellet wrapped within a moisture seal and spaced from said flyer, and first and second explosive blocks having moisture-resistant coatings and located adjacent said explosive pellet such that detonation of said wrapped explosive pellet by said flyer detonates said first and second explosive blocks;

a barrel sleeve located between said flyer and said wrapped explosive pellet, said barrel sleeve including a passageway aligned with said bridge and extending to said explosive pellet;

a rigid housing for enclosing said bridge, flyer, explosive charge and barrel sleeve; and a spring located between said first and second explosive blocks, for yieldably urging said first explosive block against said wrapped explosive pellet and for yieldably urging said wrapped explosive pellet and said flyer against opposite sides of said barrel sleeve, to seal the passageway of said barrel sleeve;

wherein the passage of an electrical current through said bridge vaporizes the bridge and propels said flyer through the barrel sleeve passageway to impact upon and detonate said wrapped explosive pellet.

* * * * *